US005791408A

United States Patent [19]

Seem

[11] Patent Number: 5,791,408

[45] Date of Patent: Aug. 11, 1998

[54] AIR HANDLING UNIT INCLUDING CONTROL SYSTEM THAT PREVENTS OUTSIDE AIR FROM ENTERING THE UNIT THROUGH AN EXHAUST AIR DAMPER

[75] Inventor: John E. Seem, Shorewood, Wis.

[73] Assignee: Johnson Service Company, Milwaukee, Wis.

[21] Appl. No.: 599,776

[22] Filed: Feb. 12, 1996

[51] Int. Cl.[6] ..... F25B 29/00

[52] U.S. Cl. ..... 165/250; 165/248; 165/249; 165/251; 165/59; 236/49.3; 454/239; 454/229; 454/236

[58] Field of Search ..... 165/248, 249, 165/250, 251, 59; 236/49.3; 454/239, 244, 229, 236

[56] References Cited

U.S. PATENT DOCUMENTS

| | | | |
|---|---|---|---|
| 4,491,061 | 1/1985 | Nishizawa et al. | 165/249 |
| 4,506,514 | 3/1985 | Lamar et al. | 165/248 |
| 4,705,457 | 11/1987 | Belusa | 236/49.3 |

OTHER PUBLICATIONS

Dickson, Dale K. P.E. et al. "*Economizer control systems*," ASHRAE Journal, 28:9, pp. 32–36, Sep. 1986.

Hays, Steve M. et al. "*Indoor Air Quality Solutions and Strategies*," Mechanical Engineering and IAQ, pp. 132–137 and 200–203.

*Primary Examiner*—John K. Ford

*Attorney, Agent, or Firm*—Quarles & Brady

[57] ABSTRACT

A control system for controlling an air handling unit. The control system links the position of an exhaust air damper and a recirculation air damper so as the exhaust air damper is opened, the recirculation air damper is closed the same amount, and vice versa. An outside air damper remains completely open at all times. The relative positions of the exhaust air damper and the recirculation air damper control the amount of outside air that is emitted into the air handling unit through the outside air damper. For each of the control states of heating with minimum outside air, cooling with outside air, mechanical cooling with maximum outside air, and mechanical cooling with minimum outside air, the outside air damper remains completely open, and the position of the exhaust air damper and the recirculation air damper are controlled based on a particular state. Sequencing strategies are employed for transitions between the control states that utilize these positions of the dampers.

31 Claims, 4 Drawing Sheets

AIR HANDLING UNIT INCLUDING CONTROL SYSTEM THAT PREVENTS OUTSIDE AIR FROM ENTERING THE UNIT THROUGH AN EXHAUST AIR DAMPER

BACKGROUND OF THE INVENTION

1. Field of the Invention

This invention relates generally to a control system and method for controlling an air handling unit and, more particularly, to a control system and method for controlling an air handling unit in which control of an outside air damper, a recirculation air damper, and an exhaust air damper prevents outside air from entering the air handling unit through the exhaust air damper.

2. Discussion of the Related Art

Most public buildings, such as commercial and office buildings, as well as certain residential buildings, include one or more air handling units (AHUs) that circulate controlled air throughout the building so as to provide desirable heating, cooling and air quality maintenance of the air environment within the building. A specific building may include any suitable number of AHUs depending on its size. FIG. 1 shows a plan layout view of a typical variable air volume (VAV) air handling unit 10 for such a building. The AHU 10 includes an air handling controller 12 that provides electrical control output signals to various components of the AHU 10, and is responsive to electrical input signals from various temperature, humidity, air flow rate and pressure sensors so as to control the air travelling through the AHU 10. FIG. 1 is a general depiction of a typical AHU, as it will be understood that other AHUs can take on other configurations.

The AHU 10 includes an outside air damper 14 that controls the amount of air that is emitted into the AHU 10 from the outside, an exhaust air damper 16 that controls the amount of exhaust air emitted from the AHU 10 to the outside, and a recirculation air damper 18 that controls the amount of air that is recirculated through the AHU 10. In the known air handling units, each of these dampers 14, 16 and 18 are linked together, and their positions are controlled by three damper motors 20 that receive control signals from the air handling controller 12.

Outside air emitted through the outside air damper 14 and/or recirculation air emitted through the recirculation air damper 18 is drawn as supply air through the AHU 10 by a supply fan 22 through a mixed air plenum 24. The flow rate of the outside air coming through the outside air damper 14 may be measured by a flow rate sensor 26. The supply air flow $Q_s$ is drawn through a filter 28, a heating coil 30 and a cooling coil 32. The supply air then passes through a flow station 34 that measures its flow rate, and then into the various rooms (not shown) of the building through the attached duct work (not shown), in a manner that is well understood in the art.

Return air from the duct work is drawn by a return fan 36 through an output flow station 38 that measures the flow rate of the return air, and into a return air plenum 40. The return air is partially or completely exhausted through the exhaust air damper 16, or is partially or completely recirculated as recirculation air through the recirculation air damper 18, depending on the position of the dampers 16 and 18. A sensor 42 measures the temperature and humidity of the supply air, a sensor 44 measures the temperature and humidity of the return air, and a sensor 46 measures the temperature and humidity of the air entering the air handling unit 10 through the outside air damper 14.

Typically, the supply fan 22 is controlled by the controller 12 to provide and maintain a particular static pressure within the AHU 10. A static pressure sensor (not shown) is positioned at a suitable location within the duct work of the AHU 10 to provide an indication of the static pressure. The return fan 36 is generally used to maintain a constant difference between the supply air flow rate and the return air flow rate. This is referred to as volume matching.

Known VAV air handling units are generally controlled to maintain a constant set point temperature of the supply air, usually at or about 55° F. This is accomplished by controlling the heating coil 30, the cooling coil 32, and the dampers 14, 16 and 18 to provide the desired air temperature. The set point temperature is measured by the temperature sensor 42 adjacent to the supply fan 22. Typically, there are four states of control depending on the outside air temperature. These states include (1) heating with the minimum outside air required for ventilation, (2) cooling with outside air, (3) mechanical cooling with maximum outside air, and (4) mechanical cooling with the minimum outside air required for ventilation. When it is cold outside, the control is generally in state (1). As the outside temperature rises, the control switches to the states (2), (3) and (4) in order. FIG. 2 shows sequencing through these states as a graph of the fraction of outside air to supply air versus the outside air temperature.

Current air handling units typically link the position of the exhaust air damper 16, the recirculation air damper 18, and the outside air damper 14. The exhaust air damper 16 and the outside air damper 14 are normally closed, and the recirculation air damper 18 is normally open. In the known AHUs, the position of the outside air damper 14 and the exhaust air damper 16 are positioned in unison in that as the outside air damper 14 is closed, the exhaust air damper 16 is closed the same amount, and as the exhaust air damper 16 is opened, the outside air damper 14 is opened the same amount. The recirculation air damper 18 is moved depending on the position of the outside air damper 14 and the exhaust air damper 16. Either a mechanical linkage or an electronic control system maintains such a relationship between the dampers 14, 16 and 18.

For traditional AHU's, the following equations describe the relationship between the damper positions.

$$\theta_{ex}=1-\theta_{re} \quad (1)$$

$$\theta_{out}=1-\theta_{re} \quad (2)$$

where, $\theta_{ex}$ is the fraction of the fully open position of the exhaust air damper 16;

$\theta_{re}$ is the fraction of the fully open position of the recirculation air damper 18; and $\theta_{out}$ is the fraction of the fully open position of the outside air damper 14.

The current configuration and operation of known AHU's as outlined above has a problem. Because the return fan 36 is generally used to maintain a constant difference between the supply air flow rate and the return air flow rate, the discharge air within the return air plenum 38 is sometimes below the atmospheric pressure outside of the building, depending on the outside air temperature and the state of control. In this condition, tests have shown that outside air can enter the AHU 10 through the exhaust air damper 16. Frequently, the exhaust air outlet is located near parking lots and garages, fume hood discharges, or various other low air quality areas. Therefore, the outside air quality at this location is sometimes inferior. Because this air may enter the AHU 10 through the exhaust air damper 16, inferior air may be circulated into the building, and may have the potential to cause certain problems, such as illness, headaches, other health related symptoms, or loss of work productivity.

What is needed is a control system and method that controls the known air handling units so as to eliminate the potential that air can be emitted into the unit through an exhaust air outlet.

SUMMARY OF THE INVENTION

In accordance with the teachings of the present invention, a control system for controlling an air handling unit is disclosed. The control system links the position of an exhaust air damper and a recirculation air damper so as the exhaust air damper is opened, the recirculation air damper is closed the same amount, and vice versa. An outside air damper remains completely open at all times. Therefore, for each of the control states of heating, cooling with outside air, mechanical cooling with maximum outside air, and mechanical cooling with minimum outside air, the outside air damper remains completely open, and the position of the exhaust air damper and the recirculation air damper are controlled based on the particular state. Sequencing strategies for transitions between the control states are employed that utilize these positions of the dampers. Alternate sequencing methods are employed for air handling units based on volume matching, in combination with those systems that measure and do not measure the outside air flow rate in real-time.

This control strategy of the invention offers a number of advantages. These advantages include energy savings due to reduction in fan power because the pressure drop for a given flow rate through the outside air damper is lower, and savings because outside air that enters the exhaust air damper is not conditioned, i.e., cooled with chilled water or heated with hot water.

Additional objects, advantages and features of the present invention will become apparent from the following description and appended claims, taken in conjunction with the accompanying drawings.

DETAILED DESCRIPTION OF THE PREFERRED EMBODIMENTS

Figure 1:
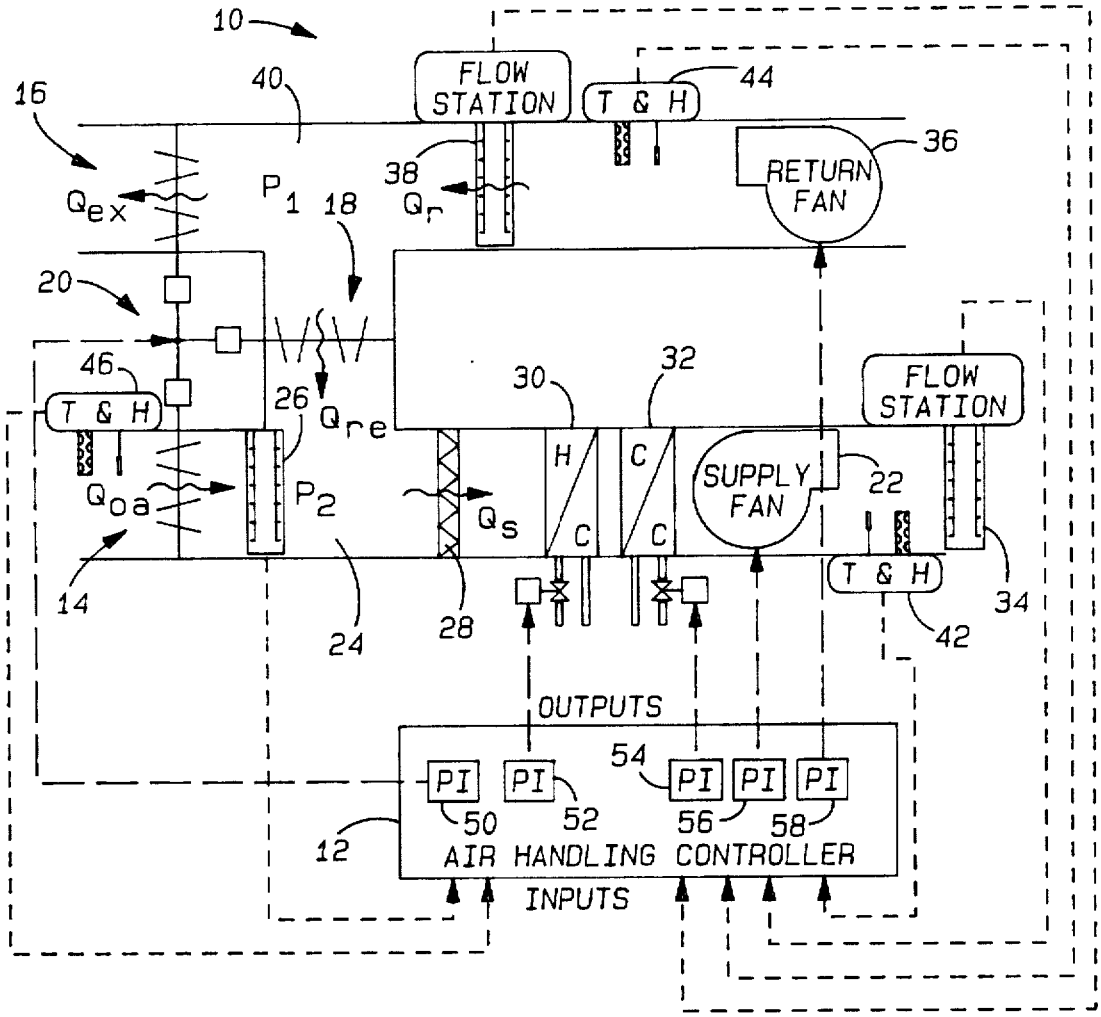
FIG. 1 is a plan layout view of an air handling unit.
Figure 2:
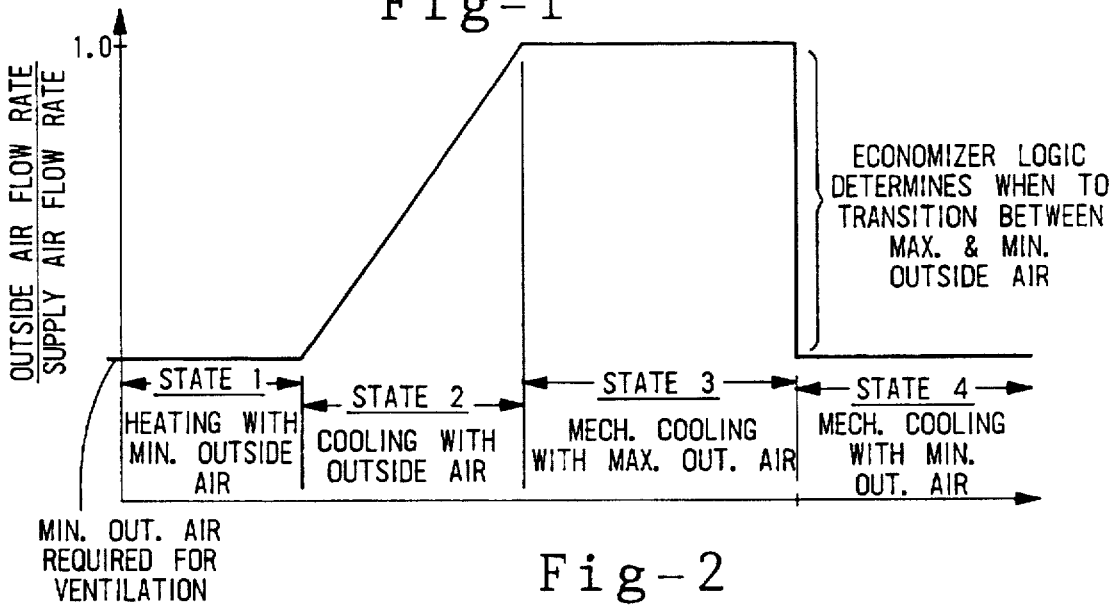
FIG. 2 is a graph of different states of control of the air handling unit of FIG. 1 showing the fraction of outside air to supply air versus outside air temperature.

The following discussion of the preferred embodiments directed to a control method for an air handling unit is merely exemplary in nature, and is in no way intended to limit the invention or its applications or uses.

This invention proposes providing a new AHU control strategy to prevent the occurrence of outside air being emitted into the air handling unit 10 through the exhaust air damper 16. This strategy includes linking the position of the exhaust air damper 16 and the recirculation air damper 18 relative to each other, and maintaining the outside air damper 14 completely open at all times, for all of the different control states. The positions of the exhaust air damper 16 and the recirculation air damper 18 are controlled relative to each other so as to control the amount of outside air that is drawn through the outside air damper 14 into the air handling unit 10. If the recirculation air damper 18 is completely open and the exhaust air damper 16 is completely closed, then the amount of outside air emitted through the outside air damper 14 is at a maximum, and is the supply flow rate minus the return flow rate. If the exhaust air damper 16 is completely open and the recirculation air damper 18 is completely closed, then the amount of outside air emitted through the outside air damper 14 is at a maximum, and is equal to the supply flow rate.

In order to discuss the relationship between the exhaust air damper 16 and the recirculation air damper 18 for the different control states, it may first be necessary to review the equations for modeling air flow in the AHU 10. The following equations are based on the conservation of mass and energy.

Performing mass balances for the mixed air plenum 24 and the return air plenum 40 provides the equations:

$$Q_r=Q_{ex}+Q_{re} \tag{3}$$

$$Q_s=Q_{oa}+Q_{re} \tag{4}$$

where, $Q_r$ is the return air flow rate;

$Q_{ex}$ is the flow rate of the air being discharged from the AHU 10 through the exhaust air damper 16;

$Q_{re}$ is the recirculation air flow rate;

$Q_s$ is the supply air flow rate; and $Q_{oa}$ is the flow rate of air entering the AHU 10 through the outside air damper 14.

These air flows are shown in FIG. 1. The air flow rates are related to air velocities and damper areas by the equations:

$$Q_{ex}=V_{ex}A_{ex} \tag{5}$$

$$Q_{oa}=V_{oa}A_{oa} \tag{6}$$

$$Q_{re}=V_{re}A_{re} \tag{7}$$

where, $A_{ex}$ is the area of the exhaust air damper 16;

$A_{oa}$ is the area of the outside air damper 14;

$A_{re}$ is the area of the recirculation air damper 18;

$V_{ex}$ is the velocity of air leaving the AHU 10 through the exhaust air damper 16;

$V_{oa}$ is the velocity of air entering the AHU 10 through the outside air damper 14; and $V_{re}$ is the velocity of air going from the return air plenum 40 to the mixed air plenum 24 through the recirculation air damper 18.

If the static pressure in the return air plenum 40 is greater than atmospheric pressure ($P_a$), then return air will leave the AHU 10 through the exhaust air damper 16. The energy equation for return air leaving the AHU 10 through the exhaust air damper 16 is given by:

$$\frac{P_1}{\rho}+\frac{V_{ex}^2}{2}=\frac{P_a}{\rho}+(C_{exd}+C_{exit}+C_{screen})\frac{V_{ex}^2}{2} \quad (8)$$

where, $P_1$ is static pressure in the return air plenum 40, $\rho$ is the density of air;

$P_a$ is the atmospheric pressure;

$C_{exd}$ is the loss coefficient for the exhaust air damper 16;

$C_{exit}$ is the exit loss coefficient; and $C_{screen}$ is the loss coefficient for the screen.

The density of air is assumed to be constant. The loss coefficient for the dampers is a function of the damper position. For opposed and parallel blade dampers, the loss coefficient can be estimated by the equation:

$$C_{damper}=a_0e^{a_1\theta+a_2\theta^2} \quad (9)$$

where, $a_1$, $a_1$, and $a_2$ are constants that are determined from nonlinear regression, and $\theta$ is the fraction that the damper is fully open. For example, if a damper is half open, then $\theta$ is 0.5.

If the atmospheric pressure ($P_a$) is greater than the static pressure in the return air plenum 40, then air will enter the AHU 10 through the exhaust air damper 16. The energy equation for outside air entering the AHU 10 through the exhaust air damper 16 is given by:

$$\frac{P_a}{\rho}=\frac{P_1}{\rho}+\frac{V_{ex}^2}{2}+(C_{exd}+C_{en}+C_{screen})\frac{V_{ex}^2}{2} \quad (10)$$

where $C_{en}$ is the entrance loss coefficient. The energy equation for air entering the AHU 10 through the outside air damper 14 is given by:

$$\frac{P_a}{\rho}=\frac{P_2}{\rho}+\frac{V_{oa}^2}{2}+(C_{oad}+C_{en}+C_{screen})\frac{V_{ex}^2}{2} \quad (11)$$

where, $P_2$ is the static pressure in the mixed air plenum 24, and $C_{oad}$ is the loss coefficient for the outside air damper 14.

The energy equation for air flow from the return air plenum 40 to the mixed air plenum 24 is given by:

$$\frac{P_1}{\rho}=\frac{P_2}{\rho}+C_{red}\frac{V_{re}^2}{2} \quad (12)$$

where $C_{red}$ is the loss coefficient for the recirculation air damper 18.

Controller logic for the air handling controller 12 to control the relative positions of the exhaust air damper 16 and the recirculation air damper 18 is needed to change their positions during the sequencing between the different control states of heating, cooling with outside air, mechanical cooling with maximum outside air, and mechanical cooling with minimum outside air. Various methods can be used to sequence between the different control states. Two sequencing methods will be described below that can be used with the proposed control strategy. Of course, other sequencing methods may be used within the scope of the invention. Both of these methods will work with an AHU that uses volume matching to control the return fan 36. One of the methods is specifically used for control strategies that measure the outside air flow rate in real-time, such as, by the flow rate sensor 26, and the other method is specifically used for those strategies that do not measure the outside air flow rate in real-time.

Figure 3:
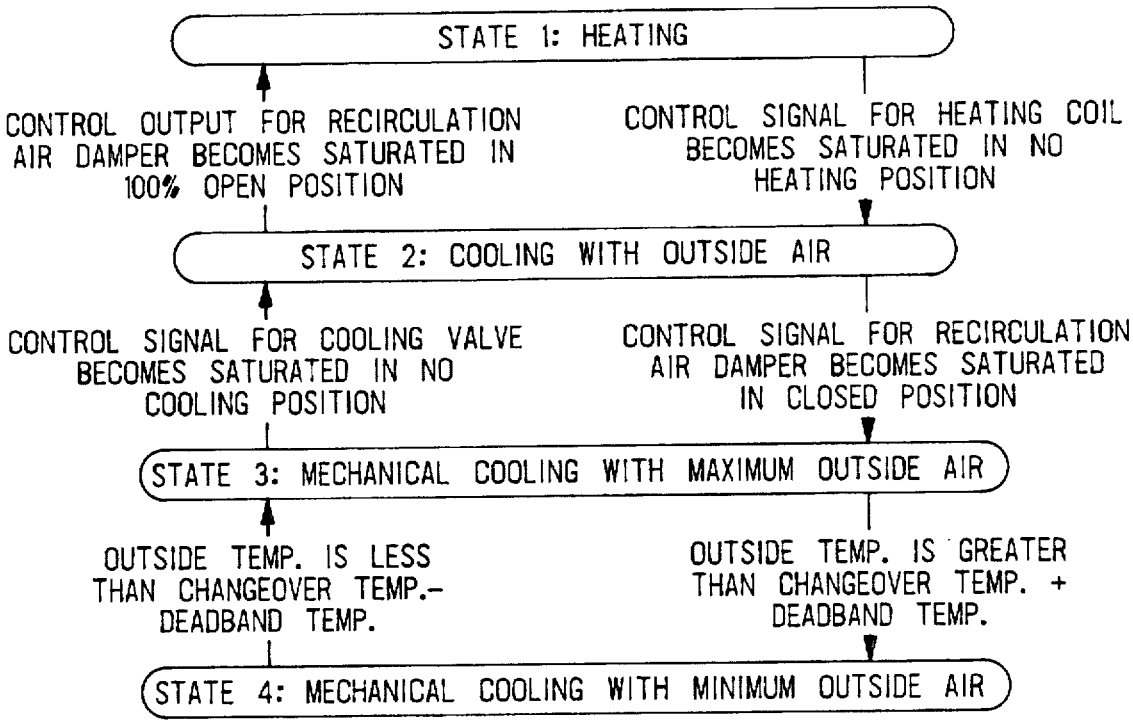
FIG. 3 is a state transition diagram for controlling a VAV air handling unit with volume matching control and no real-time measurement of outside air flow rate.

Currently, the majority of AHU's do not measure the outside air flow rate in real-time. For these control systems, the return fan 36 is controlled for volume matching. A state transition diagram showing sequencing between the different states for this type of AHU is shown in FIG. 3, and can be used to establish the switch between the different control states. For all of the control states, single-input single-output (SISO) proportional integral (PI) feedback controllers are used to control the supply and return fans 24 and 36. The SISO feedback controllers are well known controllers that actively control the various components of the AHU 10, and are located in the air handling controller 12. Known air handling controllers generally incorporate only a single feedback controller for controlling the multiple components. According to the invention, the air handling controller 12 includes a feedback controller 50 for controlling the damper motors 20, a feedback controller 52 for controlling the heating coil 30, a feedback controller 54 for controlling the cooling coil 32, a feedback controller 56 for controlling the supply fan 24, and a feedback controller 58 for controlling the return fan 36. Typically, feedback controllers of this type are set at a particular output between a 0% output and a 100% output depending on the input condition, where 0% is no signal and 100% is maximum signal. The supply fan 24 is controlled to maintain the static pressure in the supply air duct, and the return fan 36 is controlled to maintain a constant difference between the supply air flow rate and the return air flow rate.

In the heating state, the feedback controller 56 is used to control the supply fan 24, the feedback controller 58 is used to control the return fan 36, and the feedback controller 52 is used to control the heating coil 30. The feedback controller 52 controls the amount of heated water passing through the coils of the heating coil 30 to maintain the supply air temperature at the set point. The exhaust air damper 16 is completely closed, and the recirculation and outside air dampers 18 and 14 are 100% open. The controller 12 goes to the cooling with outside air state after the control signal from the heating coil 30 becomes saturated in at a zero heating position. This occurs when the output from the feedback controller 52 stays at the zero heating position for a time period equal to a predetermined saturation time. The saturation time is selected based on the type of feedback loop being controlled. For example, the saturation time may be five minutes. However, as will be appreciated by those skilled in the art, other saturation times can be equally affective.

Figure 4:
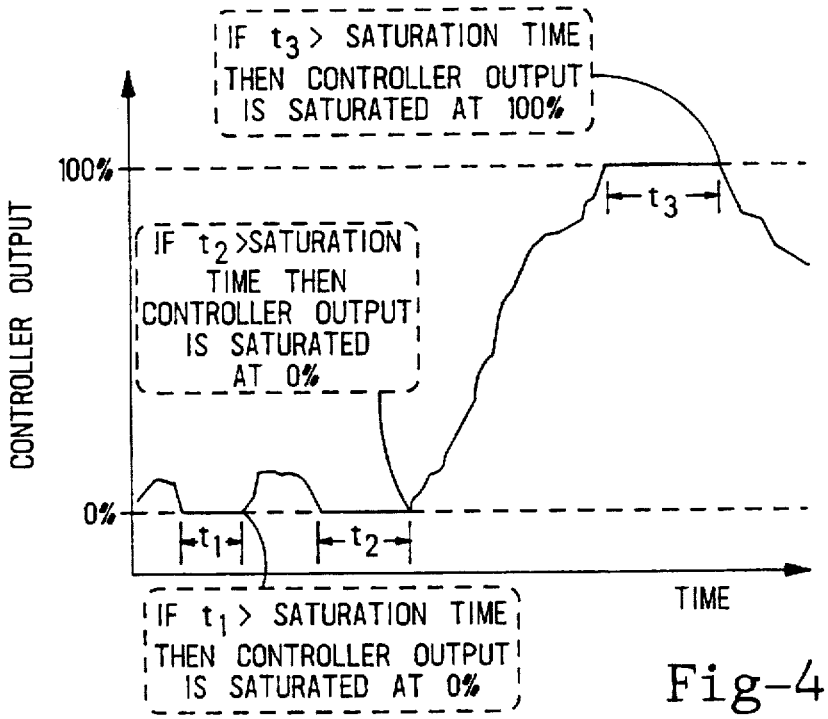
FIG. 4 is a graph of controller output versus time showing a method for determining saturated conditions.

FIG. 4 is a graph of feedback controller output versus time that demonstrates a method used to check for saturated conditions. During the time period $t_1$, the output of a certain feedback controller has been continuously at zero. If $t_1$ is greater than the saturation time, then the control output is considered saturated at zero, otherwise, the control input is not considered saturated. Following the time period $t_1$, the output of the controller is greater than zero and less than 100%, therefore there is no saturation. After a certain amount of time, the output of the controller returns to zero and remains there for a time period equal to $t_2$. If $t_2$ is greater than the saturation time, then the output of the controller is again considered to be saturated at zero. Finally, the output of the controller reaches 100% output signal and remains there for a time period equal to $t_3$. If $t_3$ is greater than the saturation time, then the output of the controller 12 is considered saturated at 100% signal.

In the cooling with outside air state, the feedback controller 56 is used to control the supply fan 24, the feedback controller 58 is used to control the return fan 36, and the feedback controller 50 is used to change the position of the exhaust air and recirculation air dampers 16 and 18 to adjust the fraction of outside air in the supply air to maintain the supply air temperature at the set point temperature. Positions for the exhaust air damper 16 and the recirculation air damper 18 are linked together with software and/or hardware to maintain the relationship given in equation (2). The fraction of outside air to supply air will increase as the recirculation air damper 18 closes and the exhaust air damper 16 opens. In this state, the outside air damper 14 will be completely open and there will be no mechanical cooling. A transition to the heating state occurs after the control signal for the recirculation air damper 18 becomes saturated in the completely open position, i.e., the damper 18 stays open longer than the saturation time. A transition to the mechanical cooling with maximum outside air state occurs after the control signal for the recirculation air damper 18 becomes saturated in the closed position. The saturation time for the damper 18 can also be five minutes, or any other suitable saturation time for a particular application.

to the mechanical cooling with minimum outside air state. The changeover temperature is a predetermined outside temperature selected depending on the climate of a particular area. The deadband temperature prevents transitions between these states due to small changes in the outside air temperature. Typically, the deadband temperature is on the order of ½°–1° F. For this transition, economizer logic based on temperature can be used. Economizer logic based on enthalpy could also be used to determine the time to switch between the states. A discussion of providing economizer control systems can be found in the article Dixon, Dale K. "Economizer Control Systems," ASHRAE Journal, Vol. 28, No. 9, pp. 32–36, September, 1986.

In the mechanical cooling with minimum outside air state, the feedback controller 56 controls the supply fan 22, the feedback controller 58 controls the return fan 36, and the feedback controller 54 adjusts the flow rate of chilled water through the cooling coil 32 to maintain the temperature set point. There is no heating, the exhaust air damper 16 is closed, and the recirculation air damper 18 is completely open. When the outside air temperature becomes less than the changeover temperature minus the deadband temperature, the controller 12 transitions from the mechanical cooling with minimum outside air state to the mechanical cooling with maximum outside air state.

Table 1 below gives a general description summarizing the discussion above of the control strategy for an AHU with volume matching control and no real-time measurement of outside air flow rate.

TABLE I

| State | Feedback Control | Other Outputs |
|---|---|---|
| 1. Heating | Control Supply Temp. with Heating Coil<br>Control Static Pres. with Supply Fan<br>Volume Matching Control with Return Fan | Exhaust Air Damper Closed<br>Recirculation Air Damper 100% Open<br>Outdoor Air Damper 100% Open<br>No Mechanical Cooling |
| 2. Cooling with Outdoor Air | Control Supply Temp. with Recirculation & Exhaust Air Dampers<br>Control Static Pressure with Supply Fan<br>Volume Matching Control with Return Fan | Outdoor Air Damper 100% Open<br>No Heating<br>No Mechanical Cooling |
| 3. Mechanical Cooling with Maximum Outdoor Air | Control Supply Temp. with Cooling Coil<br>Control Static Pressure with Supply Fan<br>Volume Matching Control with Return Fan | Exhaust Air Damper 100% Open<br>Recirculation Air Damper Closed<br>Outdoor Air Damper 100% Open<br>No Heating |
| 4. Mechanical Cooling with Minimum Outdoor Air | Control Supply Temp. with Cooling Coil<br>Control Static Pressure with Supply Fan<br>Volume Matching Control with Return Fan | Exhaust Air Damper Closed<br>Recirculation Air Damper 100% Open<br>Outdoor Air Damper 100% Open<br>No Heating |

Figure 5:
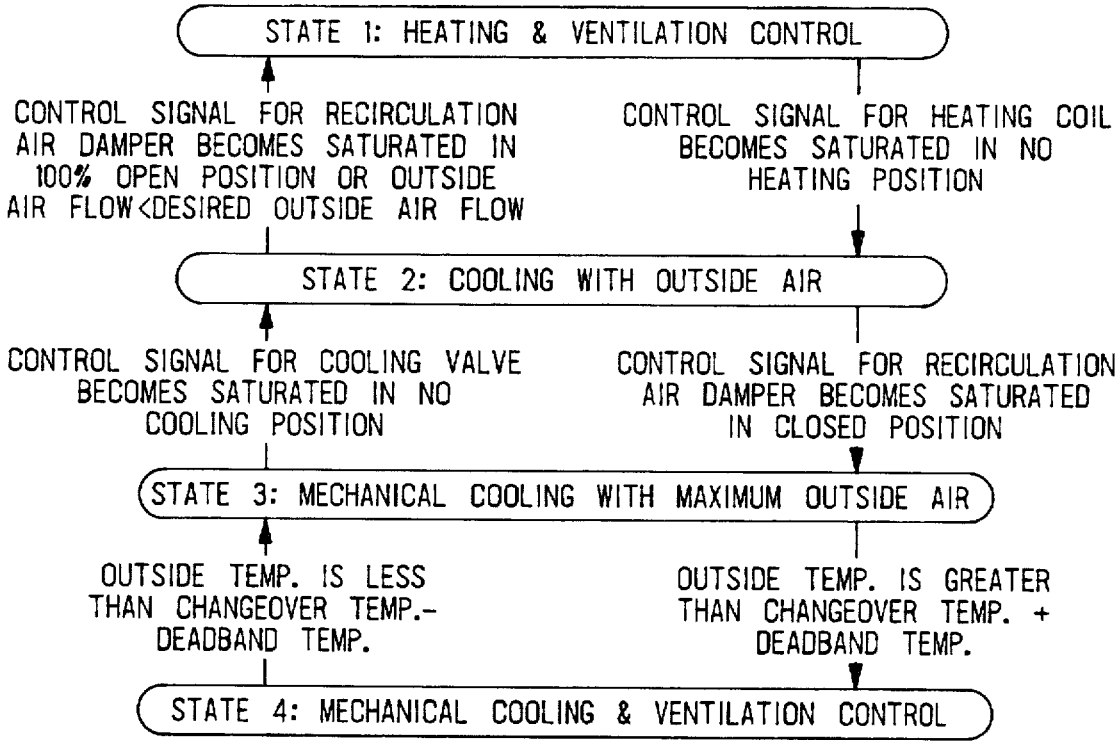
FIG. 5 is a state transition diagram for controlling a VAV air handling unit with volume matching control and a real-time measurement of outside air flow rate.

In the mechanical cooling with maximum outside air state, the feedback controller 56 controls the supply fan 24, the feedback controller 58 controls the return fan 36, and the feedback controller 54 adjusts the flow rate of chilled water through the cooling coil 32 for cooling. Controlling the cooling coil 32 maintains the supply air at the set point temperature. In this state, the recirculation air damper 18 is closed, and both the exhaust air damper 16 and the outside air damper 14 are completely open. If the outside air temperature drops and the control signal from the feedback controller 54 to the cooling coil 32 becomes saturated in a no cooling position (0% signal), the controller 12 provides a transition to the cooling with outside air state. When the outside air temperature is greater than a changeover temperature plus a deadband temperature, control is transferred from the mechanical cooling with maximum outside air state FIG. 5 shows a state transition diagram for those AHUs that measure the outside air flow rate in real-time in accordance with the proposed control strategy of the invention. This state diagram is similar to the state diagram of FIG. 3 discussed above. However, since the outside air flow rate is measured in real-time, to ensure adequate ventilation for indoor air quality (IAQ). American Society of Heating, Refrigeration and Air-Conditioning Engineers (ASHRAE) sets a minimum amount of air flow per occupant in a building. This minimum air flow rate is currently 15 $ft^3$/min. Because of this, state (1) is changed to a heating and ventilation control state, and state (4) is a mechanical cooling and ventilation control state so as to control and maintain this minimum flow rate. Therefore, in the heating and ventilation control state, an additional feedback controller is incorporated that was not necessary for the heating state discussed above. This feedback controller is feedback controller 50 for controlling outside air flow with the exhaust and recirculation air dampers 16 and 18. Further, for the mechanical cooling and ventilation control, the feedback controller 50 is also used for this purpose. In the heating state discussed above, the recirculation air damper 18 was maintained completely open. In the heating and ventilation control state and the mechanical cooling and ventilation control state, the position of the recirculation air damper and the exhaust air damper 16 are controlled in association with Equation (2). Additionally, if the controller 12 is in the cooling with outside air state, the controller 12 will return to the heating and ventilation control state if the control signal for recirculation air damper becomes saturated in the completely open position, as above, or if the outside air flow rate falls below the desired outside air flow rate.

Table II below summarizes the control of the AHU with volume matching control and real-time measurements of outside air flow as just described.

Figure 8:
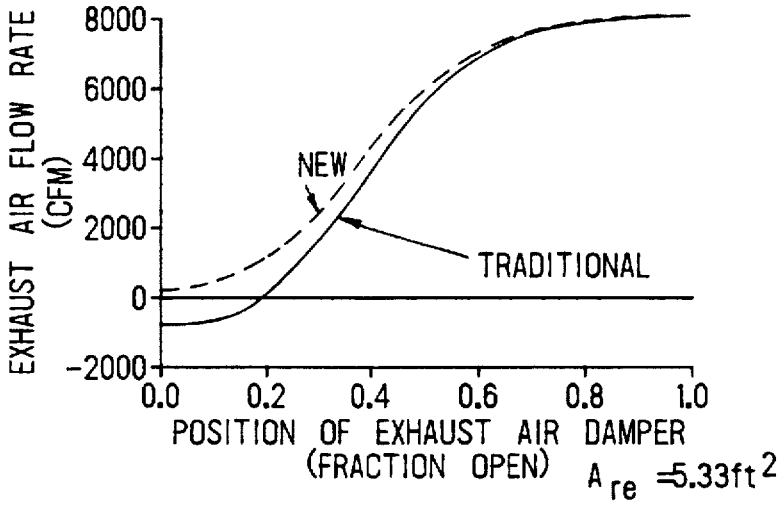
FIG. 8 is a graph of exhaust air flow rate versus position of an exhaust air damper comparing a traditional control strategy and a control strategy of the invention of a modified base case simulation.

Simulations were performed to compare the known control strategies with the proposed control strategy for three alternatives to the base simulation discussed above. FIG. 8 is a graph that shows the exhaust air flow through the exhaust air damper 16 versus the position of the exhaust air damper 16 for both control strategies when the area ($A_{re}$) of the recirculating air damper 18 was changed from 16 $ft^2$ to 5.33 $ft^2$.

Figure 9:
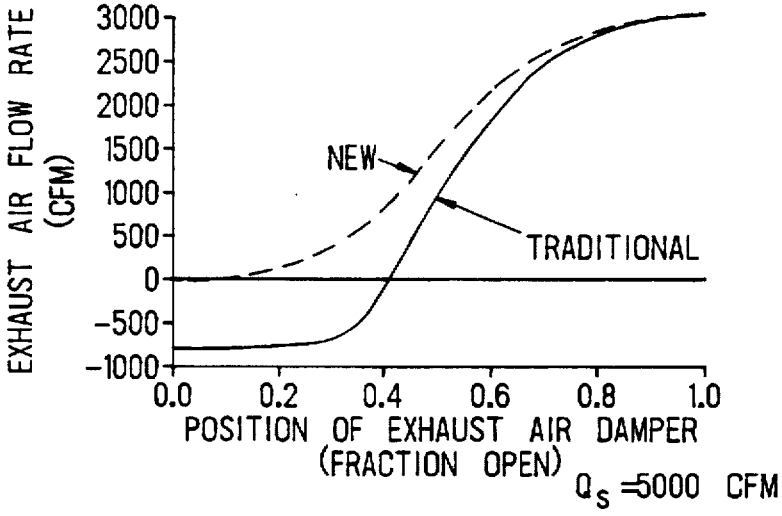
FIG. 9 is a graph of exhaust air flow rate versus position of an exhaust air damper comparing a traditional control strategy and a control strategy of the invention of another modified base case simulation.

FIG. 9 is a graph that shows the exhaust air flow rate versus the position of the exhaust air damper 16 to compare the control strategies when the supply air flow rate ($Q_s$) was changed from 10,000 CFM to 5,000 CFM.

Figure 10:
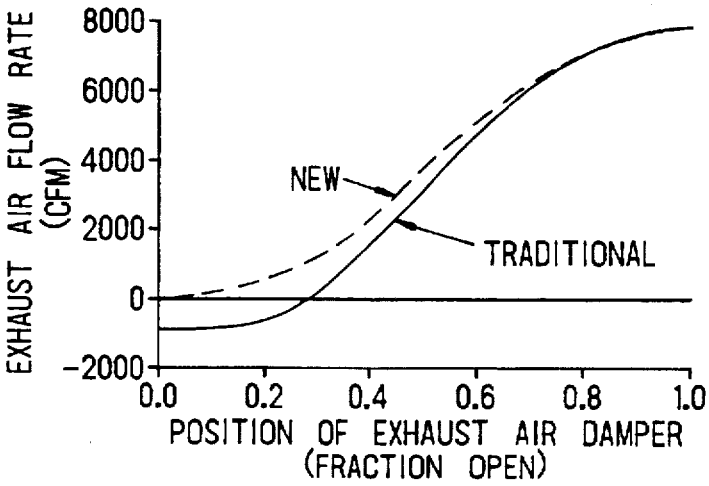
FIG. 10 is a graph of exhaust air flow rate versus position of an exhaust air damper for comparing a traditional control strategy and a new control strategy of the invention of another modified base case simulation.

FIG. 10 is a graph that shows the exhaust air flow rate versus the position of the exhaust air damper 16 to compare the control strategies when parallel blade dampers are used instead of opposed blade dampers. Note that at low exhaust damper positions, the air flow rate through the exhaust air damper 16 is negative for the known control strategy. This means that air is entering the AHU 10 through the exhaust air damper 16.

TABLE II

| State | Feedback Control | Other Outputs |
|---|---|---|
| 1. Heating and Ventilation Control | Control Supply Temp. with Heating Coil<br>Control Outdooe Air Flow with Recirculation and Exhaust Air Dampers<br>Control Static Pres. with Supply Fan<br>Volume Matching Control with Return Fan | Exhaust Air Damper 100% Open<br>No Mechanical Cooling |
| 2. Cooling with Outdoor Air | Control Supply Temp. with Recirculation & Exhaust Air Dampers<br>Control Static Pressure with Supply Fan<br>Volume Matching Control with Return Fan | Outdoor Air Damper 100% Open<br>No Heating<br>No Mechanical Cooling |
| 3. Mechanical Cooling with Maximum Outdoor Air | Control Supply Temp. with Cooling Coil<br>Control Static Pressure with Supply Fan<br>Volume Matching Control with Return Fan | Exhaust Air Damper 100% Open<br>Recirculation Air Damper Closed<br>Outdoor Air Damper 100% Open<br>No Heating |
| 4. Mechanical Cooling and Ventilation Control | Control Supply Temp. with Cooling Coil<br>Control Outdoor Air Flow with Recirculation and Exhaust Air Dampers<br>Control Static Pressure with Supply Fan<br>Volume Matching Control with Return Fan | Outdoor Air Damper 100% Open<br>No Heating |

Figure 6:
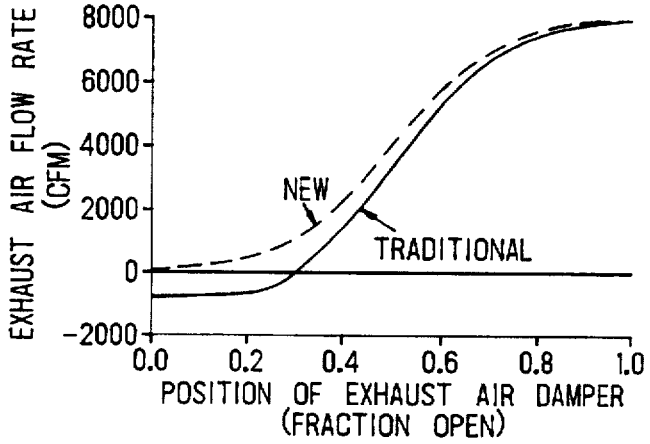
FIG. 6 is a graph of exhaust air flow rate versus position of an exhaust air damper comparing a traditional control strategy and a control strategy of the invention for a base case simulation.

FIG. 6 is a graph that shows the flow rate of air through the exhaust air damper 16 versus the position of the exhaust air damper 16 for a base case simulation comparing both the known control strategy (traditional) and the control strategy of the invention (new). The base case simulation was based on the following parameters for the above equations. The constants $a_0$, $a_1$, and $a_2$ are for opposed blade dampers.

$a_0$=5768 $a_1$=−9.453 $a_2$=0

$A_{oa}$=25 $ft^2$ $A_{ex}$=16 $ft^2$ $A_{re}$=16 $ft^2$ $C_{en}$=0.5 $C_{exit}$=1.0 $C_{screen}$=0.32

$Q_s$=10,000 CFM $Q_r$=−2000 CFM $P_a$=14.7 psia $\rho$=0.075 $lb_m/ft^3$

When air enters the AHU 10 through the exhaust air damper 16, the exhaust air flow rate will be negative. For the known control strategy, outside air enters the AHU 10 through the exhaust air damper 16 when the position of the exhaust air damper 16 is less than 30% open. For the control strategy of the invention, outside air never enters the AHU 10 through the exhaust air damper 16.

Figure 7:
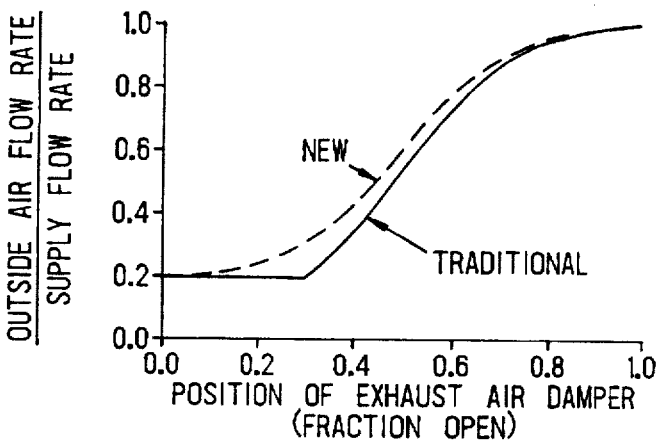
FIG. 7 is a graph of outside air flow rate to supply flow rate versus position of an exhaust air damper comparing a traditional control strategy and a control strategy of the invention for the base case simulation.

FIG. 7 is a graph that shows the fraction of outside air flow rate to supply air flow rate versus the position of the exhaust air damper 16 for the base case to compare the known control strategy and the proposed control strategy of the invention. Note that at low exhaust air damper positions, a fraction of outside air with the traditional control strategy remains constant.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for controlling an air handling unit for a plurality of control states, said method comprising the steps of:

controlling a supply fan so as to provide supply air within the air handling unit;

controlling a return fan so as to provide return air within the air handling unit;

controlling the position of an exhaust air damper so as to control the amount of the return air that is emitted from the air handling unit;

controlling the position of a recirculation air damper so as to control the amount of the return air that is recirculated in the air handling unit; and controlling the position of the exhaust air damper and the recirculation air damper so as to control the amount of outside air emitted into the air handling unit and maintaining the position of the outside air damper in a substantially completely open position for all of the plurality of control states so as to prevent outside air from entering the air handling unit through the exhaust air damper.

2. The method according to claim 1 wherein the plurality of control states include a heating state, a cooling with outside air state, a mechanical cooling with maximum outside air state and a mechanical cooling with minimum outside air state.

3. The method according to claim 2 further comprising the step of controlling a heating device, wherein when the control is in the heating state, the step of controlling the position of the exhaust air damper includes maintaining the exhaust air damper in a substantially completely closed position, the step of controlling the position of the recirculation air damper includes maintaining the recirculation air damper in a substantially completely open position, and the step of controlling the heating device includes controlling the heating device so as to maintain the supply air at a particular temperature.

4. The method according to claim 2 wherein when the control is in the cooling with outside air state, the steps of controlling the position of the exhaust air damper and the recirculation air damper include adjusting the position of the exhaust air damper and the recirculation air damper to adjust the fraction of outside air in the supply air to maintain the supply air at a particular temperature.

5. The method according to claim 2 further comprising the step of controlling a cooling device, wherein when the control is in the mechanical cooling with maximum outside air state, the step of controlling the position of the recirculation air damper includes maintaining the recirculation air damper substantially completely closed, the step of controlling the position of the exhaust air damper includes maintaining the exhaust air damper substantially completely open and the step of controlling the cooling device includes controlling the cooling device to maintain the supply air at a particular temperature.

6. The method according to claim 2 further comprising the step of controlling a cooling device, wherein when the control is in the mechanical cooling with minimum outside air state, the step of controlling the exhaust air damper maintains the exhaust air damper substantially completely closed, the step of controlling the recirculation air damper maintains the recirculation air damper substantially completely open and the step of controlling the cooling device includes controlling the cooling device so as to maintain the supply air at a particular temperature.

7. The method according to claim 2 further comprising the step of changing the control state from the heating control state to the cooling with outside air state after a heating device provides zero heating for a predetermined saturation time.

8. The method according to claim 2 further comprising the step of changing the control state from the cooling with outside air state to the mechanical cooling with maximum outside air state when the step of controlling the recirculation air damper maintains the recirculation air damper in a completely closed position for a predetermined saturation time, and further comprising the step of changing the control state from the cooling with outside air state to the heating state when the step of controlling the recirculation air damper maintains the recirculation air damper in a completely open position for a predetermined saturation time.

9. The method according to claim 2 further comprising the step of changing the control state from the mechanical cooling with maximum outside air state to the mechanical cooling with minimum outside air state when an outside air temperature is greater than a predetermined changeover temperature plus a predetermined deadband temperature, and further comprising the step of changing the control state from the mechanical cooling with maximum outside air state to the cooling with outside air state when a cooling device provides zero cooling for a predetermined saturation period.

10. The method according to claim 1 wherein the plurality of control states include a heating and ventilation control state, a cooling with outside air state, a mechanical cooling with maximum outside air state and a mechanical cooling and ventilation control state.

11. The method according to claim 10 further comprising the step of changing the control state from the cooling with outside air state to the heating and ventilation control state when either the step of controlling the recirculation air damper maintains the recirculation air damper in a completely open position for a predetermined saturation time or an outdoor air flow rate is below a predetermined outside air flow rate.

12. The method according to claim 1 wherein the step of controlling the supply fan controls the supply fan in a manner that maintains a particular static pressure within a supply air duct that is attached to the air handling unit.

13. The method according to claim 1 wherein the step of controlling the return fan includes controlling the return fan in a manner that maintains a constant difference between a supply air flow rate from the supply fan and a return air flow rate so as to provide volume matching.

14. The method according to claim 1 wherein the steps of controlling the position of the exhaust air damper and controlling the position of the recirculation air damper includes the step of linking the exhaust air damper and the recirculation air damper so that as the exhaust air damper is closed a certain amount, the recirculation air damper is opened that amount, and as the exhaust air damper is opened a certain amount, the recirculation air damper is closed that amount.

15. A control system for controlling air flow through an air handling unit over a plurality of control states, said control system comprising:

a supply fan, said supply fan providing supply air within the air handling unit;

a return fan, said return fan providing return air within the air handling unit;

an exhaust air damper, said exhaust air damper being positionable to control the amount of the return air that is emitted from the air handling unit;

a recirculation air damper, said recirculation air damper being positionable to control the amount of the return air that is recirculated in the air handling unit;

an outside air damper, said outside air damper being positionable to allow outside air into the air handling unit; and a controller means for controlling the position of the exhaust air damper and the recirculation air damper relative to each other to control the amount of outside air emitted into the air handling unit through the outside air damper, and for controlling the outside air damper to be in a substantially completely open position for all of the plurality of control states so as to prevent outside air from entering the air handling unit through the exhaust air damper.

16. The control system according to claim 15 wherein the plurality of control states include a heating state, a cooling with outside air state, a mechanical cooling with maximum outside air state and mechanical cooling with minimum outside air state.

17. The control system according to claim 16 further comprising a heating device, wherein when the control is in the heating state, the controller means maintains the exhaust air damper in a completely closed position, the recirculation air damper in a completely open position and controls the heating device to maintain the supply air at a particular temperature.

18. The control system according to claim 16 wherein when the control is in the cooling with outside air state, the controller means controls the positions of the exhaust air damper and the recirculation air damper so that the fraction of outside air and the supply air maintains the supply air at a particular temperature.

19. The control system according to claim 16 further comprising a cooling device, wherein when the control is in the mechanical cooling with maximum outside air state, the controller means maintains the recirculation air damper completely closed and the exhaust air damper completely open.

20. The control system according to claim 16 further comprising a cooling device, wherein when the control is in the mechanical cooling with minimum outside air state, the controller means maintains the exhaust air damper completely closed and the recirculation air damper completely opened, and controls the cooling device to maintain the supply air at a predetermined temperature.

21. The control system according to claim 16 wherein the controller means changes the control state from the heating state to the cooling with outside air state after the heating device provides zero heating for a predetermined saturation time.

22. The control system according to claim 16 wherein the controller means changes the control state from the cooling with outside air state to the mechanical cooling with maximum outside air state after the recirculation air damper has been maintained in a completely closed position for a predetermined saturation time, and the controller means changes the control state from the cooling with outside air state to the heating state when the recirculation air damper has been maintained in a completely open position for a predetermined saturation time.

23. The control system according to claim 16 further comprising a cooling device, wherein the controller means changes the control state from the mechanical cooling with maximum outside air state to the mechanical cooling with minimum outside air state when an outside air temperature is greater than the predetermined changeover temperature plus a predetermined deadband temperature, and the controller means changes the control state from the mechanical cooling with maximum outside air state to the cooling with outside air state when the cooling device provides zero cooling for a predetermined saturation period.

24. The control system according to claim 15 wherein the controller means includes a plurality of feedback controllers, wherein a first feedback controller controls the supply fan, a second feedback controller controls the return fan, and a third feedback controller controls the position of the exhaust air damper and the recirculation air damper.

25. The control system according to claim 15 wherein the control means controls the supply fan so as to maintain a particular static pressure within the air handling unit.

26. The control system according to claim 15 wherein the controller means controls the return fan in a manner that maintains a constant difference between a supply air flow rate from the supply fan and a return air flow rate so as to provide volume matching.

27. The control system according to claim 15 wherein the controller means links the position of the exhaust air damper and the position of the recirculation air damper so that as the exhaust air damper is closed a certain amount, the recirculation air damper is opened that amount and as the exhaust air damper is open a certain amount, the recirculation air damper is closed that amount.

28. A control system for controlling air flow through an air handling unit over a plurality of control states, said control system comprising:

a supply fan, said supply fan providing supply air within the air handling unit;

a return fan, said return fan providing return air withing the air handling unit;

an exhaust air damper, said exhaust air damper being positionable to control the amount of the return air that is emitted from the air handling unit;

a recirculation air damper, said outside recirculation air damper being positionable to control the amount of the return air that is to be recirculated in the air handling unit;

an outside air damper, said outside air damper being positionable to allow outside air into the air handling unit; and a controller including a plurality of feedback control devices, wherein as first feedback control device controls the supply fan, a second feedback control device controls the return fan, and a third feedback control device controls the position of the exhaust air damper and the recirculation air damper relative to each other, and wherein the controller maintains the outside air damper in a substantially completely open position through all of the plurality of control states.

29. The control system according to claim 28 wherein the controller controls the relative positions of the exhaust air damper and the recirculation air damper so as to control the amount of outside air emitted into the air handling unit through the outside air damper.

30. The control system according to claim 28 wherein the controller controls the position of the exhaust air damper and the recirculation air damper in a manner that as the exhaust air damper is closed a certain amount, the recirculation air damper is opened that amount, and as the exhaust air damper is opened a certain amount, the recirculation air damper is closed that amount.

31. The control system according to claim 28 wherein the plurality of control states include a heating state, a cooling with outside air state, a mechanical cooling with maximum outside air state and a mechanical cooling with minimum outside air state.

* * * * *